US006789753B2

(12) United States Patent
Aoki et al.

(10) Patent No.: US 6,789,753 B2
(45) Date of Patent: Sep. 14, 2004

(54) FUEL INJECTION VALVE

(75) Inventors: Hiromasa Aoki, Nagoya (JP); Takashi Iwanaga, Toyohashi (JP); Michiharu Miyata, Kariya (JP)

(73) Assignee: Denso Corporation, Kariya (JP)

( * ) Notice: Subject to any disclaimer, the term of this patent is extended or adjusted under 35 U.S.C. 154(b) by 248 days.

(21) Appl. No.: 10/207,115

(22) Filed: Jul. 30, 2002

(65) Prior Publication Data

US 2003/0025004 A1 Feb. 6, 2003

(30) Foreign Application Priority Data

Aug. 1, 2001 (JP) ..... 2001-233480
May 27, 2002 (JP) ..... 2002-152052

(51) Int. Cl.[7] ..... F02M 59/00; F02M 39/00; B05B 1/30

(52) U.S. Cl. ..... 239/533.2; 239/533.3; 239/585.1; 239/585.5; 239/88

(58) Field of Search ..... 239/533.2, 533.3, 239/533.7, 533.8, 533.9, 533.12, 88–93, 585.1–585.5, 67–69; 251/129.15, 129.21, 127

(56) References Cited

U.S. PATENT DOCUMENTS 4,635,603 A * 1/1987 Hara ..... 123/383
5,150,684 A * 9/1992 Jun ..... 123/446
5,890,653 A * 4/1999 Kelly ..... 239/5
6,276,335 B1 8/2001 Egler et al.
6,367,453 B1 4/2002 Igashira et al.
6,371,084 B1 4/2002 Betz

FOREIGN PATENT DOCUMENTS

DE 199 36 943 A1 2/2001

* cited by examiner

*Primary Examiner*—Davis Hwu
(74) *Attorney, Agent, or Firm*—Nixon & Vanderhye P.C.

(57) ABSTRACT

In a fuel injection valve, a flow-out passage is provided on a downstream side thereof with an out-orifice. The out-orifice is provided around a periphery of an inlet opening thereof with an inlet circumferential edge with which a flow of fuel to be ejected from a pressure control chamber via the out-orifice is swirled so that turbulent flow is forcibly formed. Then, the turbulent flow is maintained until the fuel is ejected. Dimensions of the out-orifice satisfy the formulas, $R/D \leqq 0.2$ and $L/D \leqq 1.2$, where R is corner radius of the inlet circumferential edge of the out-orifice, D is inner diameter thereof and L is axial length thereof. Accordingly, fuel injection is stable with less fuel amount fluctuation in each cycle even when fuel pressure and temperature are relatively low.

13 Claims, 7 Drawing Sheets

FUEL INJECTION VALVE

CROSS REFERENCE TO RELATED APPLICATION

This application is based upon and claims the benefit of priority of Japanese Patent Applications No. 2001-233480 filed on Aug. 1, 2001 and No. 2002-152052 filed on May 27, 2002, the contents of which are incorporated herein by reference.

BACKGROUND OF THE INVENTION

1. Field of the Invention

The present invention relates to a fuel injection valve whose injection amount and timing are adjusted in such a manner that a control valve controls fuel pressure of a pressure control chamber.

2. Description of the Prior Art

A conventional fuel injection valve, which is applied to an accumulated pressure type fuel injection system, has a pressure control chamber to which high pressure fuel accumulated in a common rail is supplied, a throttled fuel ejecting passage through which the high pressure fuel is ejected, and an electromagnetic valve operative to open and close the throttled fuel ejecting passage. With this electromagnetic valve, injection amount and timing of the fuel injection valve are adjusted by controlling fuel pressure of the pressure control chamber.

The conventional fuel injection valve has a drawback that, when fuel of the pressure control chamber is ejected via the throttled fuel ejecting passage under conditions that both of fuel temperature and pressure are relatively low, fuel flow state is not uniform and is likely to change between turbulent flow and laminar flow. As a result, fuel injection in each injection cycle is unstable and each injection amount tends to fluctuate.

SUMMARY OF THE INVENTION

It is an object of the present invention to provide a fuel injection valve in which a flow state of fuel ejected from a pressure control chamber via a throttled passage does not change between turbulent and laminar flows, resulting in less fluctuation of injection amount per each cycle.

To achieve the above object, in a fuel injection valve, a nozzle is provided with an injection bore and has a needle axially movable for opening and closing the injection bore. Fuel pressure in a pressure control chamber, to which high pressure fuel is supplied, is operative to urge the needle in a direction of closing the injection bore. A fuel flow-out passage is provided at an outlet thereof with an orifice through which the high pressure fuel introduced thereto from the pressure control chamber is ejected, when a control valve opens the fuel flow-out passage.

With the fuel injection valve mentioned above, the fuel flow-out passage is further provided with a guide member that, when the outlet thereof is opened by the control valve, guides a flow of the fuel introduced thereto from the pressure control chamber in such a manner that one of two flow states consisting of a turbulent flow state and a laminar flow state is exclusively formed at first and, then, maintained, always as far as fuel temperature is within a range from −30 to 80° C. and fuel pressure is within 10 to 50 M Pa.

It is preferable that the orifice has a smooth cylindrical straight portion whose inner diameter is smaller than that of the fuel flow-out passage on an upstream side thereof, and the guide member is turbulent flow formation means for forcibly forming the turbulent flow state before the fuel introduced into the fuel flow-out passage from the pressure control chamber reaches the smooth cylindrical straight portion of the orifice and turbulent flow maintenance means for maintaining the turbulent flow state thus formed throughout the smooth cylindrical straight portion.

In this case, it is preferable that dimension of the smooth cylindrical straight portion, which constitutes the turbulent flow maintenance means, satisfies a formula, $L/D \leqq 1.2$, where D is inner diameter of the smooth cylindrical straight portion and L is axial length of the smooth cylindrical straight portion.

As one of the turbulent flow formation means, the orifice is provided around a periphery of an inlet opening immediately adjacent the smooth cylindrical straight portion thereof with an inlet circumferential edge with which the flow of the fuel introduced into the fuel flow-out passage from the pressure control chamber is swirled so that the turbulent flow state is forcibly formed. In this case, dimension of the inlet circumferential edge of the orifice satisfy a formula, $R/D \leqq 0.2$, where R is corner radius of the inlet circumferential edge and D is the inner diameter of the smooth cylindrical straight portion.

As another one of the turbulent flow formation means, the fuel flow-out passage including the orifice is provided in an interior thereof on an upstream side of the smooth cylindrical straight portion with projections or recesses with which the flow of the fuel introduced into the fuel flow-out passage from the pressure control chamber is disturbed so that the turbulent flow state is forcibly formed.

As further one of the turbulent flow formation means, the fuel flow-out passage including the orifice is provided in an interior thereof on an upstream side of the smooth cylindrical straight portion with a flow disturbance member with which the fuel introduced into the fuel flow-out passage from the pressure control chamber is stirred so that the turbulent flow state is forcibly formed.

As still further one of the turbulent flow formation means, the fuel flow-out passage including the orifice is provided in an interior thereof on an upstream side of the smooth cylindrical straight portion with a bending portion or a step portion whose diameter is stepwise changed, with which the fuel introduced into the fuel flow-out passage from the pressure control chamber is guided to flow in a curve so that the turbulent flow state is forcibly formed. A plurality of the turbulent flow formation means mentioned above may be combined with each other.

On the other hand, when the orifice has a smooth cylindrical straight portion whose inner diameter is smaller than that of the fuel flow-out passage on an upstream side thereof, the guide member maybe laminar flow formation means for forcibly forming the fuel introduced to the fuel flow-out passage from the pressure control chamber to the laminar flow state in the smooth cylindrical straight portion on an upstream side thereof and laminar flow maintenance means for maintaining the fuel thereof in the laminar flow state thus formed throughout the smooth cylindrical straight portion on a downstream side thereof.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

First Embodiment

A fuel injection valve (injector) according to a first embodiment of the present invention is described to FIGS. 1 to 5.

Figure 3:
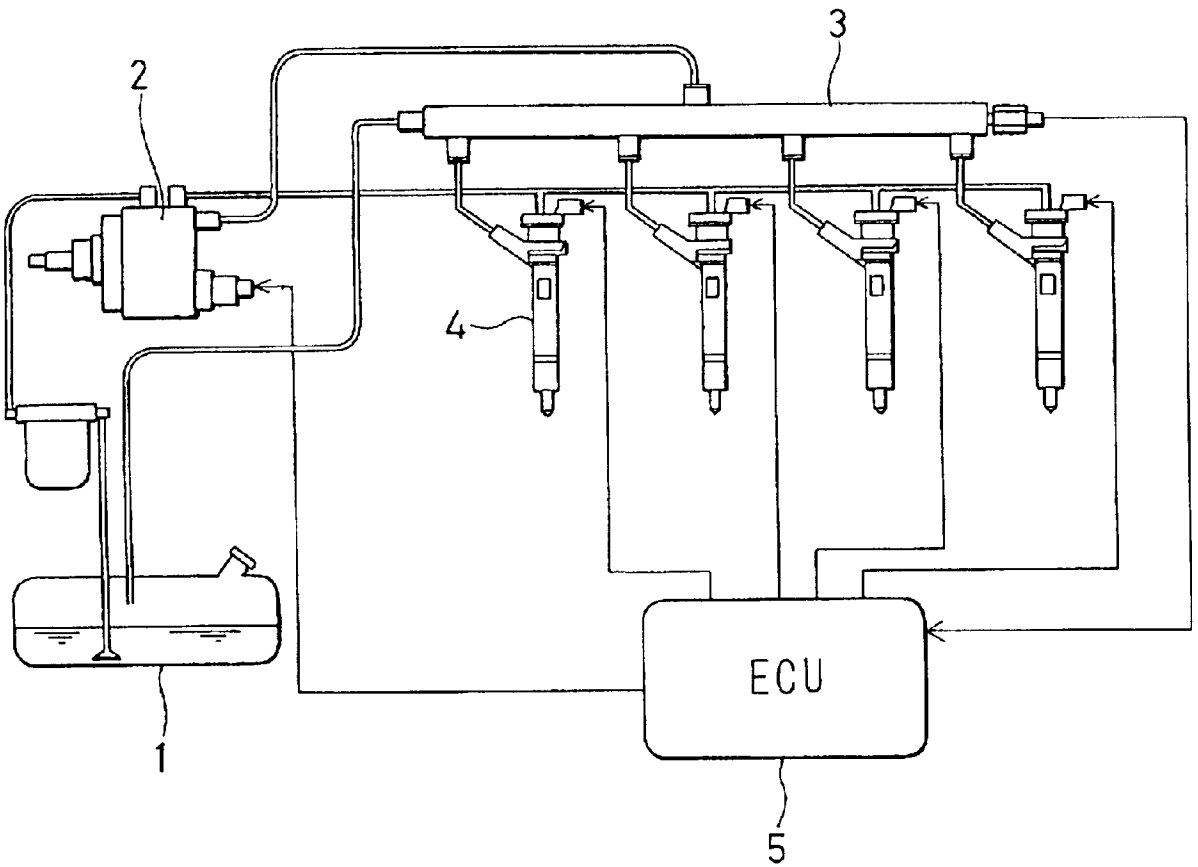
FIG. 3 is an entire view of an accumulated pressure type fuel injection system to which the injector of FIG. 1 is applied.

The fuel injection valve can be incorporated in an accumulated pressure type injection system applicable, typically, for a 4-cylinder diesel engine. As shown in FIG. 3, the accumulated pressure type injection system is composed of a fuel pump 2 which sucks fuel from a fuel tank 1 and compresses and discharges the fuel under high pressure, a common rail 3 which accumulates high pressure fuel discharged from the fuel pump 2, injectors 4 each of which injects the high pressure fuel supplied from the common rail 3 to each cylinder of the engine, and an electronic control device (ECU) 5 which controls operations of the fuel pump 2 and the injectors 4.

The injector 4 is composed of a nozzle 6, a nozzle holder 7, a hydraulic piston 8, and an electromagnetic valve (control valve) 9.

Figure 1:
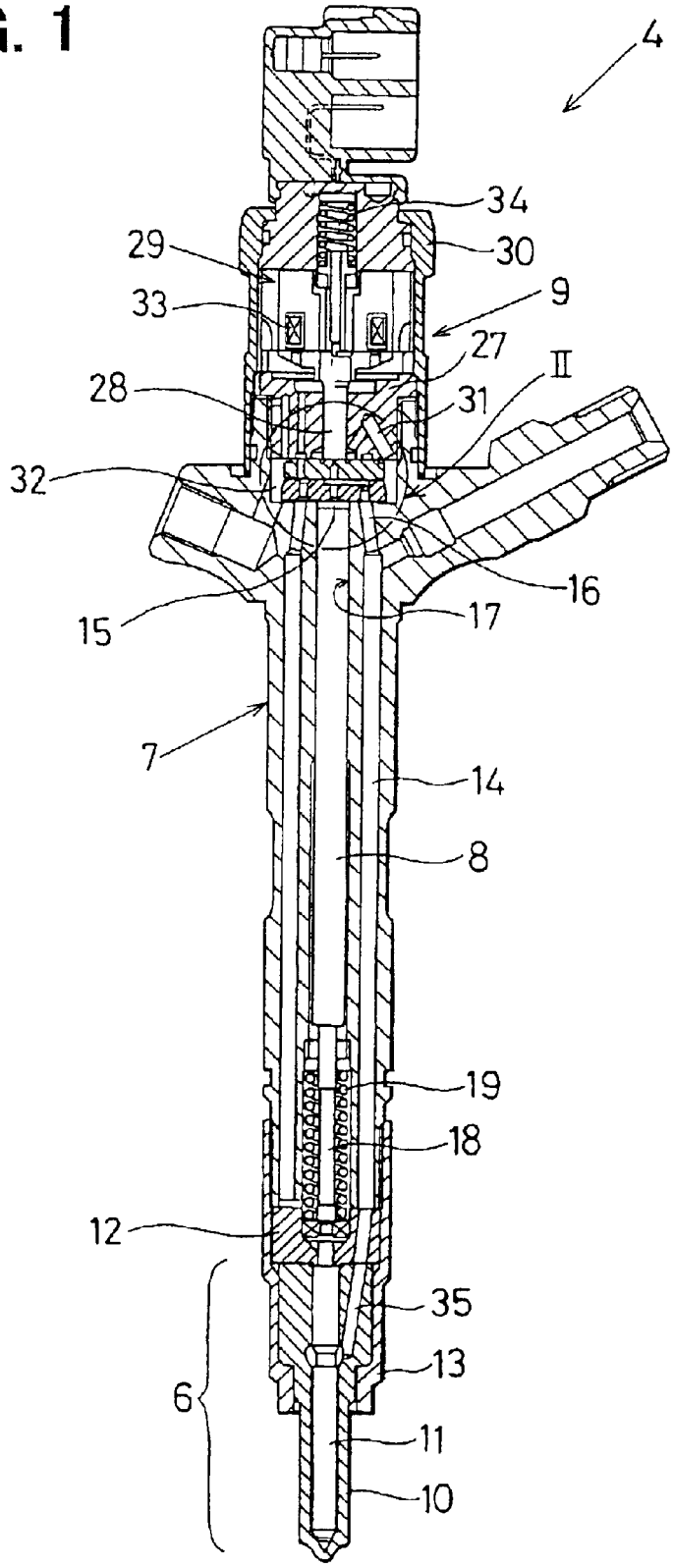
FIG. 1 is a cross sectional view of an injector according to a first embodiment of the present invention.

As shown in FIG. 1, the nozzle 6 has a nozzle body 10 provided at an axial end thereof with an injection bore (not shown) and a needle 11 slidably fitted to an interior of the nozzle body 10. The nozzle 6 is connected via a tip packing 12 to an end of the nozzle holder 7 by a retaining nut 13.

The nozzle holder 7 is provided with a fuel passage 14 and a fuel passage 16 through which the high pressure fuel supplied from the common rail 3 is delivered to the nozzle 6 and a pressure control chamber 15, respectively.

The hydraulic piston 8 is slidably fitted to a cylinder 17 provided in the nozzle holder 7 and is connected via a pressure pin 18 to the needle 11. The pressure pin 18 biased by a spring 19 presses the needle 11 in a valve closing direction (downward in FIG. 1).

Figure 2:
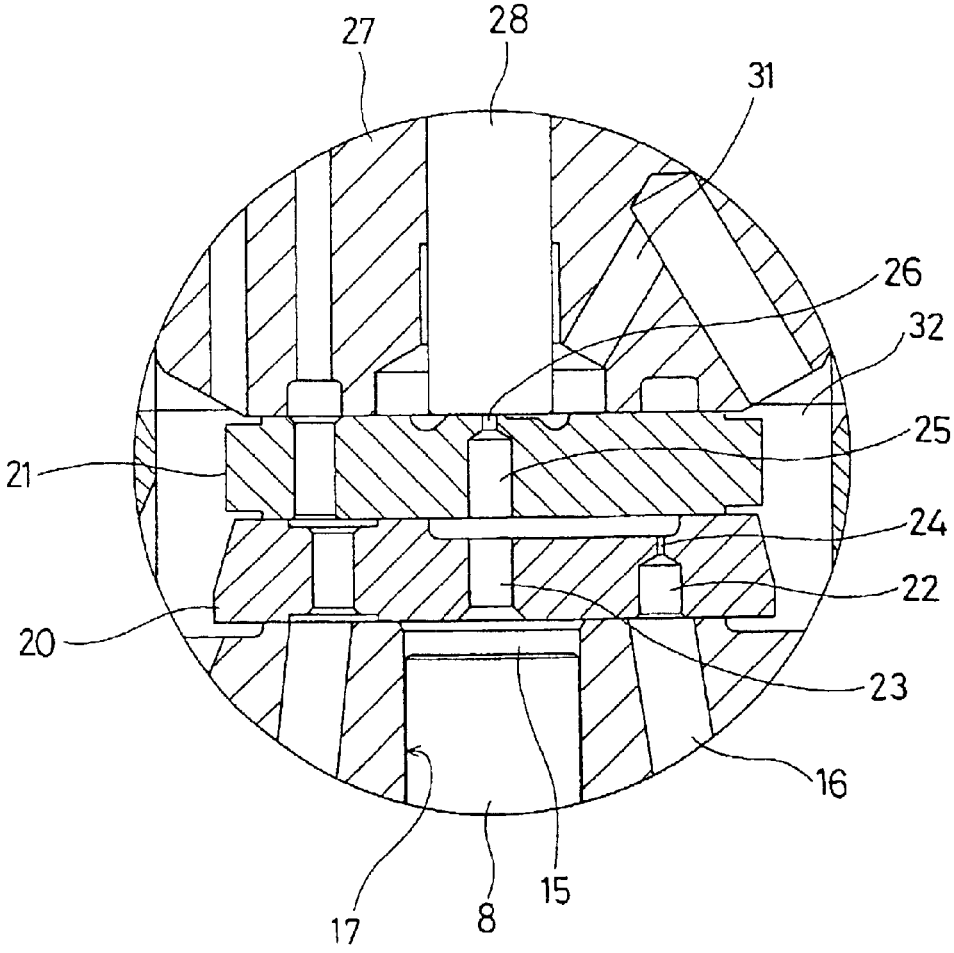
FIG. 2 is a partly enlarged cross sectional view of the injector shown by a circle II in FIG. 1.

As more clearly shown in FIG. 2, the pressure control chamber 15 is formed within the cylinder 17 above the hydraulic piston 8 and pressure of the high pressure fuel supplied to the pressure control chamber 15 acts on an upper end face of the hydraulic piston 8.

A first plate 20 and a second plate 21, which are on top of each other, are arranged above the pressure control chamber 15.

The first plate 20 is provided with a flow-in passage 22 which communicates with the fuel passage 16 in the nozzle holder 7 and with a fuel passage 23 through which the flow-in passage 22 communicates with the pressure control chamber 15. An in-orifice 24 is provided in the flow-in passage 22.

The second plate 21 is provided with a flow-out passage 25 which communicates with the pressure control chamber 15 via the fuel passage 23 provided in the first plate 20. The flow-out passage 25 is provided on a downstream side thereof with an out-orifice (throttle bore) 26. The out-orifice 26 has a smooth cylindrical straight portion whose inner diameter is smaller than that of the flow-out passage 25 on an upstream side thereof but larger than that of the in-orifice 24. The out-orifice 26 is provided around a periphery of an inlet opening thereof with an inlet circumferential edge with which the fuel to be ejected from the pressure control chamber 15 via the out-orifice 26 is swirled so that turbulent flow is formed. Then, the turbulent flow thus formed is maintained until the fuel is ejected via the out-orifice 26 to the low pressure passage 31.

Figure 4:
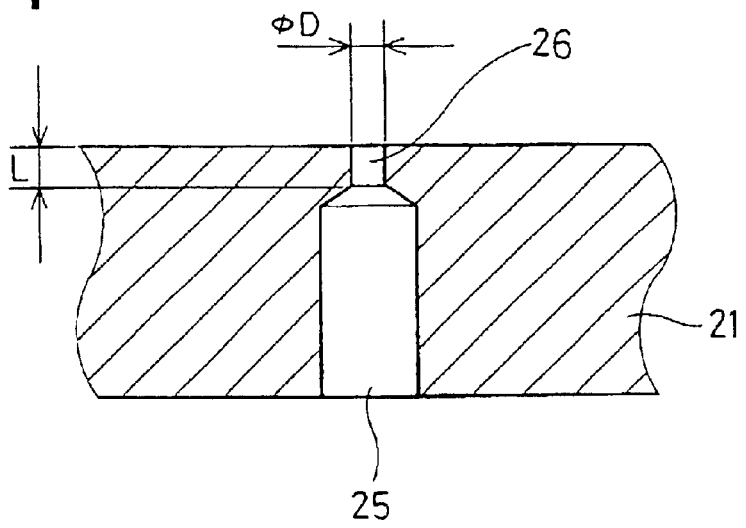
FIG. 4 is a cross sectional view of a second plate that constitutes turbulent flow formation means according to the first embodiment.
Figure 5:
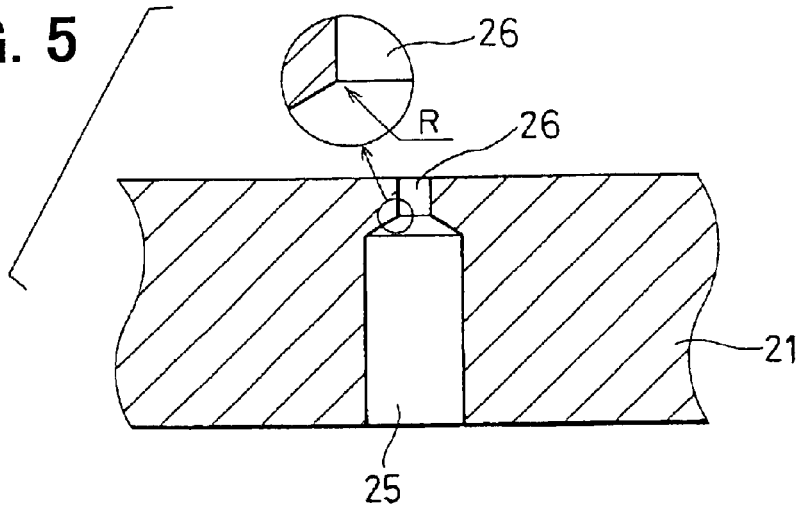
FIG. 5 is another cross sectional view of the second plate according to the first embodiment.

The out-orifice 26 is formed to satisfy the following formulas (1) and (2), as shown in FIGS. 4 and 5.

$$R/D \leqq 0.2 \quad (1)$$

$$L/D \leqq 1.2 \quad (2)$$

where R is corner radius of the inlet circumferential edge of the out-orifice 26, D is inner diameter of a smooth cylindrical straight portion of the out-orifice 26 and L is axial length of the smooth cylindrical straight portion of the out-orifice 26.

If the corner radius R is too large relative to the inner diameter D, that is, R/D is more than 0.2, the fuel flows smoothly into the out-orifice 26 via the inlet circumferential edge so that a flow of the fuel in the out-orifice 26 (the smooth cylindrical straight portion) tends to be the laminar flow. However, when R/D is relatively small, that is, the formula (1) is satisfied, the flow of the fuel in the out-orifice 26 becomes the turbulent flow since the fuel is swirled about at the inlet circumferential edge of the out-orifice 26. Accordingly, the inlet circumferential edge of the out-orifice 26 whose shape is formed to satisfy the formula (1) constitutes turbulent flow formation means.

Further, if the axial length L of the smooth cylindrical straight portion of the out-orifice 26 is too long relative to the inner diameter D thereof, the turbulent flow at the inlet of the out-orifice 26 turns to the laminar flow during the fuel flow along the cylindrical portion of the outlet-orifice 26.

However, when the formula (2) is satisfied, the turbulent flow is maintained during the fuel flow along the smooth cylindrical straight portion of the outlet-orifice 26. Accordingly, the smooth cylindrical straight portion of the out-orifice 26 whose geometry satisfies the formula (2) constitutes turbulent flow maintenance means.

As mentioned above, a combination of the turbulent flow formation means and turbulent flow maintenance means constitute a guide member that guides the fuel to be ejected from the pressure control chamber 15 via the out-orifice 26 so as to forcibly form a turbulent flow state on its way and, then, maintain the turbulent flow state.

The above phenomena is proved by an experimental test under conditions that fuel pressure is 32 MPa and temperature is minus 30° C.

As shown in FIG. 1, the electromagnetic valve 9 is composed of a valve body 27, a valve 28 and an electromagnetic actuator 29. The electromagnetic valve 9 is connected via the first and second plates 20 and 21 to an upper end of the nozzle holder 7 by a retailing nut 30.

The valve body 27 is arranged above the second plate 21 and is provided with a low pressure passage 31 which can communicate with the flow-out passage 25 provided in the second plate 21 according to a movement of the valve 28. The low pressure passage 31 communicates with a low pressure drain via a ring shaped space 32 formed around outer circumferences of the first and second plates 20 and 21.

The valve 28 is held by the valve body 27 so as to move in up and down directions therewithin. When a lower end of the valve 28 is seated on an opening periphery (seat surface) of the out-orifice 26 (outlet of the flow-out passage 25), the communication between the flow-out passage 25 and the low pressure passage 31 is interrupted.

The electromagnetic actuator 29 is operative to drive the valve 28 in use of magnetic force. The electromagnetic actuator 29 has a coil 33 for generating the magnetic force and a spring 34 for urging the valve 28 in a valve closing direction (downward in FIG. 1).

An operation of the injector 4 is described hereinafter.

High pressure fuel to be supplied from the common rail 3 to the injector 4 is introduced to an inner passage 35 and to the pressure control chamber 15. When the electromagnetic valve 9 is in a valve closing state (when the valve 28 interrupts the communication between the out-orifice 26 and the low pressure passage 31), pressure of the high pressure fuel introduced into the pressure control chamber 15 acts on the needle 11 via the hydraulic piston 8 and the pressure pin 18 and, together with the biasing force of the spring 19, urges the needle 11 in a valve closing direction.

The high pressure of the fuel introduced into the inner passage 35 of the nozzle 35 (refer to FIG. 1) acts on a pressure receiving surface of the needle 11 so that the needle 11 is urged in a valve opening direction. However, when the electromagnetic valve 9 is in a valve closing state, a force of urging the needle 11 in the valve closing direction is larger than that in the valve opening direction. Accordingly, the needle 11 never lifts and the injection bore is closed so that fuel is not injected.

When the electromagnetic valve 9 turns to a valve opening state upon energizing the coil 33 (when the valve 28 lifts), the out-orifice 26 communicates with the low pressure passage 31, so the fuel of the pressure control chamber 15 is ejected via the out-orifice 26 and the low pressure passage 31 to the low pressure drain. Even after the electromagnetic valve 9 turns to the valve opening state, supply of the high pressure fuel to the pressure control chamber 15 continues. However, the inner diameter of the out-orifice 26 through which the fuel is ejected from the pressure control chamber 15 is larger than that of the in-orifice 24 through which the fuel is supplied to the pressure control chamber 15, fuel pressure of the pressure control chamber 15 acting on the hydraulic piston 8 is reduced.

As a result, a sum of the forces of urging the needle 11 in the valve closing direction due to the fuel pressure of the control chamber and the biasing force of the spring 19 is reduced and, at a time when the force of urging the needle 11 in the valve opening direction exceeds the sum of the forces of urging the needle 11 in the valve closing direction, the needle 11 starts lifting to open the injection bore so that the fuel injection starts. At this time, the flow of the fuel ejected from the pressure control chamber 15 via the out-orifice 26 to the low pressure passage 31 is forced to form the turbulent flow and, once formed, to maintain the turbulent flow, since the geometry of the flow-out passage 25 including the out-orifice 26 satisfies the formulas (1) and (2) mentioned above.

According to the first embodiment, each fuel injection can be stably controlled and the fluctuation of the injection amount is smaller, since the turbulent flow once formed by the inlet circumferential edge of the out-orifice 26 never changes to the laminar flow as far as the out-orifice 26 is opened by the valve 28 and the fuel flows from the pressure control chamber 15 via the flow-out passage 25 to the low pressure passage 31.

Second Embodiment

Figure 6:
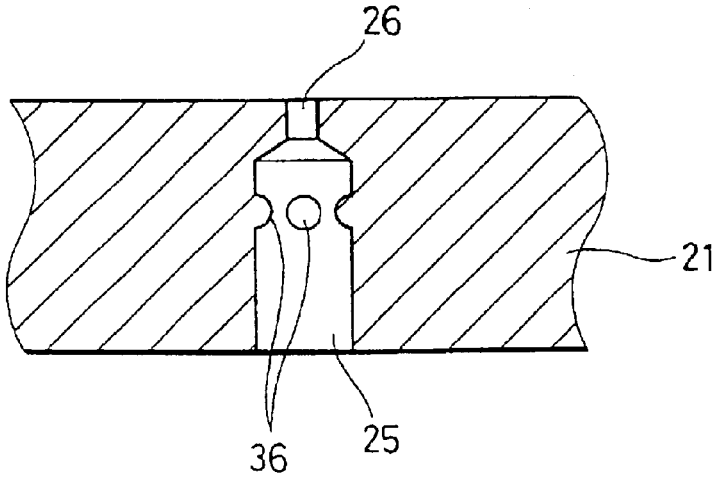
FIG. 6 is a cross sectional view of a second plate that constitutes turbulent flow formation means according to a second embodiment.

An injector according to a second embodiment has projections (or recesses) 36 provided in the flow-out passage 26 at positions upstream of the out-orifice 26, as shown in FIG. 6. The projections (or the recesses) 36 may be formed in addition to or instead of the turbulent formation means of the first embodiment and guides the fuel to be ejected from the pressure control chamber 15 via the flow-out passage 25 so as to form the turbulent flow state. The injector according to the second embodiment further has the turbulent flow maintenance means. The turbulent flow maintenance means is a smooth cylindrical straight portion of the out-orifice 26 whose axial length is short to an extent that the turbulent flow formed by the turbulent flow formation means can be maintained without converting to the laminar flow. It is preferable that the geometry of the out-orifice 26 according to the second embodiment satisfies the formula (2) mentioned above. However, a turbulent degree of the turbulent flow formed by the projections (recesses) 36 in addition to or instead of the turbulent flow formation means of the first embodiment at the inlet of the out-orifice 26 of the second embodiment is larger than that formed by the first embodiment, a value of L/D may be larger than 1.2.

Third Embodiment

Figure 7A:
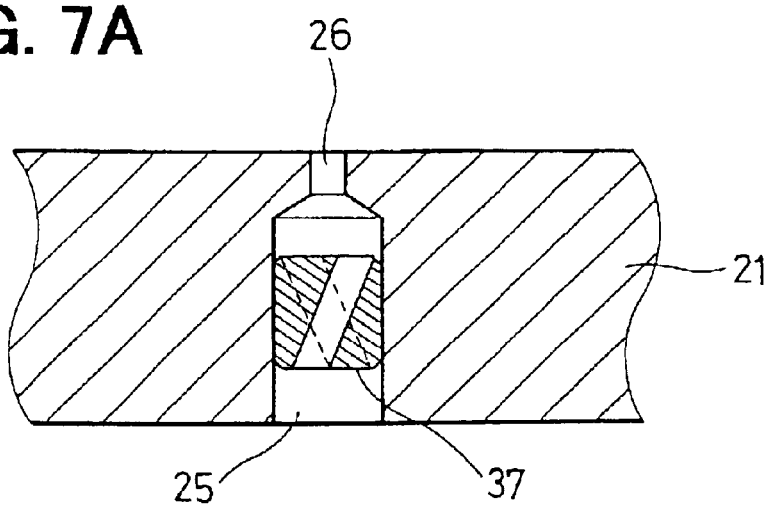
FIG. 7A is a cross sectional view of a second plate that constitutes turbulent flow formation means according to a third embodiment.
Figure 7B:
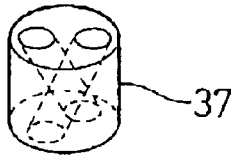
FIG. 7B is a perspective view of a flow disturbance member incorporated in the second plate of FIG. 7A.

An injector according to a third embodiment has a flow disturbance member 37 inserted into the flow-out passage 25 on an upstream side of the out-orifice 26, instead of the projections (recesses) of the second embodiment, as the turbulent flow formation means, as shown in FIG. 7. The flow disturbance member 37 is fixed to or may be axially movably fitted to an interior of the flow-out passage 25 and guides the fuel to be ejected from the pressure control chamber 15 via the flow-out passage 25 so as to form the turbulent flow state. Advantages and other structure of the third embodiment are same as those of the second embodiment.

Fourth Embodiment

Figure 8:
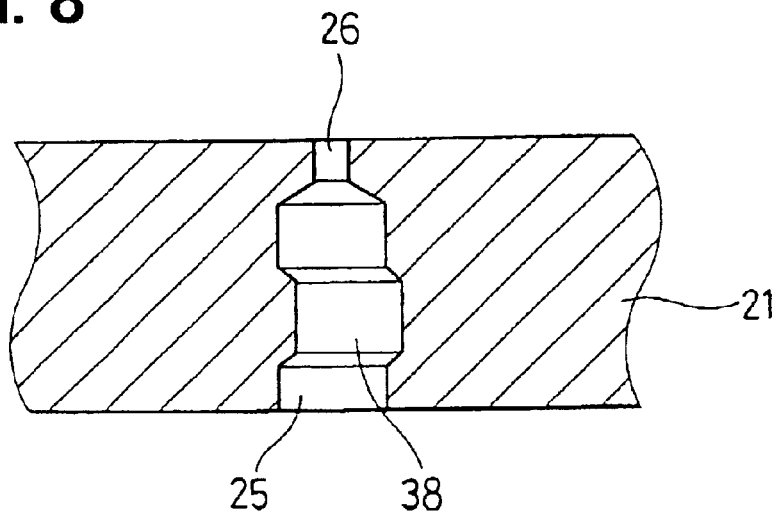
FIG. 8 is a cross sectional view of a second plate that constitutes turbulent flow formation means according to a fourth embodiment.
Figure 9:
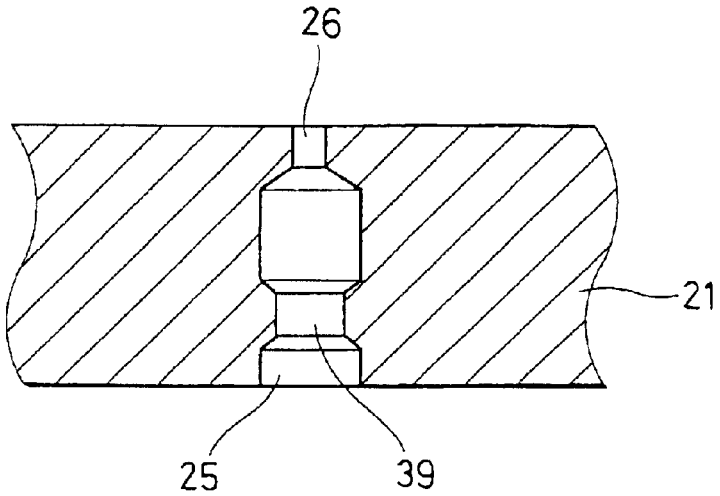
FIG. 9 is a cross sectional view of a second plate that constitutes turbulent flow formation means according to a fifth embodiment.

An injector according to a fourth embodiment has a bending portion 38 provided in the flow-out passage 25 on an upstream side of the out-orifice 25, instead of the flow disturbance member 37 of the third embodiment, as the turbulent flow formation means, as shown in FIG. 8. Advantages and other structure of the fourth embodiment are same as those of the third embodiment.

Fifth Embodiment

An injector according to a fifth embodiment has a small diameter portion 39 provided in the flow-out passage 25 on an upstream side of the out-orifice 25, instead of the bending portion of the fourth embodiment, as the turbulent flow formation means, as shown in FIG. 8. Instead of the small diameter portion 39, a large diameter portion may be provided in the flow-out passage 25, as the turbulent flow formation means. That is, the flow-out passage 25 whose inner diameter is stepwise changed constitutes the turbulent flow formation means. Advantages and other structure of the fifth embodiment are same as those of the fourth embodiment.

Figure 10A:
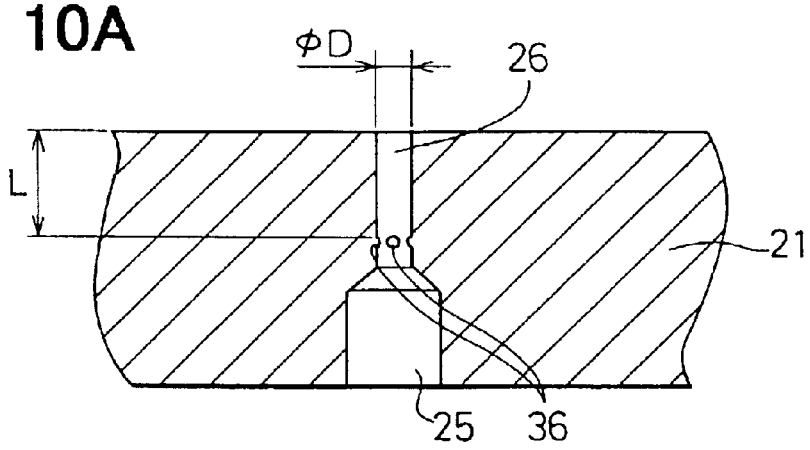
FIG. 10A is a cross sectional view of a second plate that constitutes turbulent flow formation means according to a modification of the second embodiment.
Figure 10B:
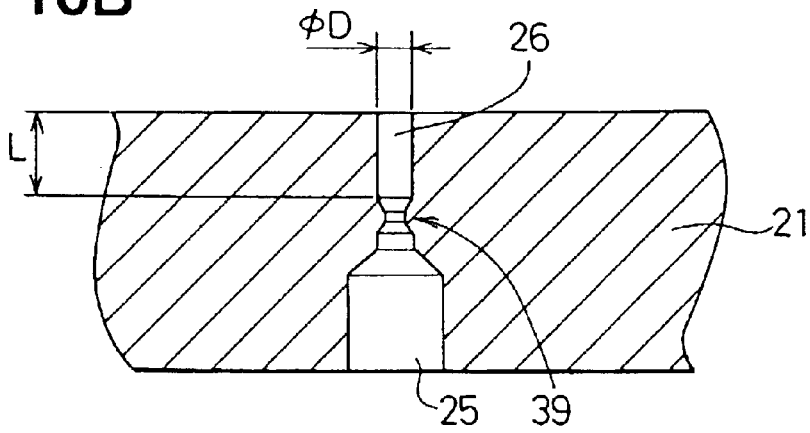
FIG. 10B is a cross sectional view of a second plate that constitutes turbulent flow formation means according to a modification of the fifth embodiment.

As a modification of any of the second to fifth embodiments, the turbulent flow formation means may be provided in the out-orifice 26 in place of the flow-out passage on an upstream side of the out-orifice 26. For example, as shown in FIG. 10A or 10B, the projections 36 or the small diameter portion 39 are provided in the out-orifice 26, not in the flow-out passage 25 on an upstream side of the out-orifice 26 according to the second or fifth embodiment. In this case, the axial length L of the smooth cylindrical straight portion of the out-orifice 26 means a length extending immediately after the turbulent flow formation means to the outlet of the out-orifice 26, as shown in FIGS. 10A and 10B.

Sixth Embodiment

Figure 11:
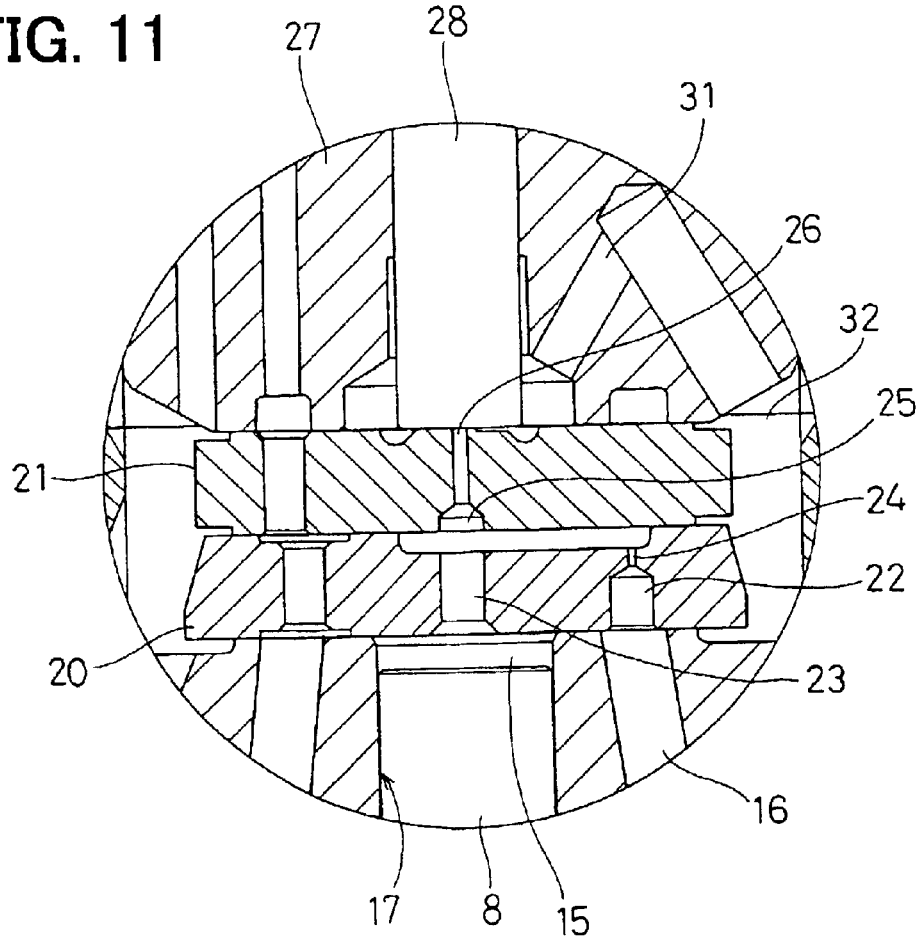
FIG. 11 is a partly enlarged cross sectional view of an injector according to a sixth embodiment.
Figure 12:
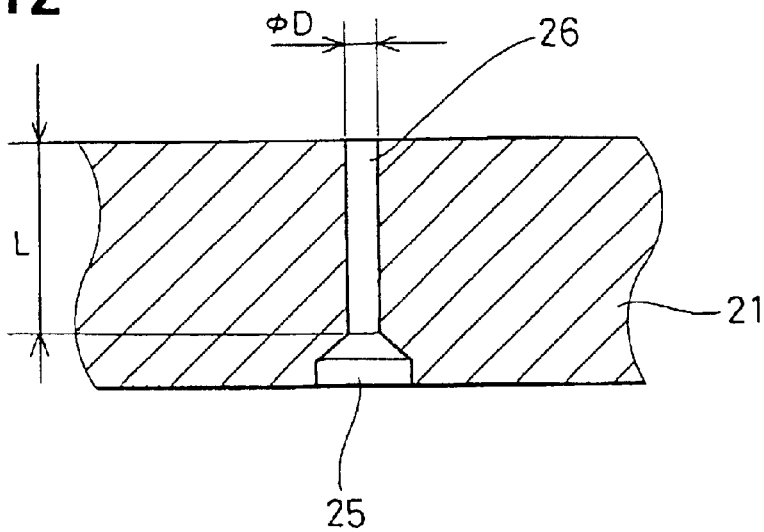
FIG. 12 is a cross sectional view of a second plate that constitutes turbulent flow formation means according to the sixth embodiment.

A injector according to a six embodiment has laminar flow formation means for forcibly forming the laminar flow state when the fuel introduced into the fuel flow-out passage 25 from the pressure control chamber 15 passes through the out-orifice 26 on an upstream side thereof and laminar flow maintenance means for maintaining the laminar flow state thus formed when the fuel thereof passes through the out-orifice 26 on a downstream side thereof, as shown in FIGS. 11 and 12.

The out-orifice 26 has a smooth cylindrical straight portion whose inner diameter is smaller than that of the fuel flow-out passage 25 on an upstream side thereof. An axial length L of the smooth cylindrical straight portion is sufficiently long relative to an inner diameter D of the smooth cylindrical straight portion.

The second plate 21 shown in FIG. 12 has a flow-out passage 25 on the upstream side whose inner diameter is larger than that (D) of the smooth cylindrical straight portion and whose axial length is remarkably shorter than that (L) of the smooth cylindrical straight portion. However, the axial length of the flow-out passage 25 on the upstream side may be zero so that the second plate 21 is provided only with the out-orifice 26.

According to the sixth embodiment, when the valve 28 is in a valve opening state, a flow of the fuel introduced to the out-orifice 26 from the pressure control chamber 15 is forcibly formed to and, then, maintained in a laminar flow state in the out-orifice 26, since the axial length L of the smooth cylindrical straight portion is sufficiently long relative to the inner diameter D thereof. Accordingly, fuel injection is stable with less fluctuation of the injection amount in each cycle, as the flow state of the fuel passing through the out-orifice 26 is always uniform and does not show a change between the laminar and turbulent flows in each injection cycle.

It is preferable to provide the laminar flow formation and maintenance means in the second plate 21 only in a case that a demanded maximum fuel pressure (common rail pressure) is relatively low, for example, 50 M Pa. That is, if the demanded maximum fuel pressure is higher than 50 M Pa, it is preferable in view of more stable fuel injection to provide the turbulent flow formation and maintenance means according to the first to fifth embodiments.

Further, to make the formation and maintenance of the laminar flow more confident, pressure of the low pressure passage (drain passage) 31 may be relatively high to an extent that pressure difference between the pressure control chamber 15 and the low pressure passage 15 is as small as possible.

What is claimed is:

1. A fuel injection valve comprising:

a nozzle provided with an injection bore and having a needle axially movable for opening and closing the injection bore;

a pressure control chamber to which high pressure fuel is supplied, fuel pressure in the pressure control chamber being operative to urge the needle in a direction of closing the injection bore;

a fuel flow-out passage provided at an outlet thereof with an orifice, the high pressure fuel of the pressure control chamber being introduced into the fuel flow-out passage and ejected via the orifice; and a control valve arranged so as to be seated on the outlet of the fuel flow-out passage and operative to open and close the fuel flow-out passage, wherein the fuel flow-out passage is further provided with a guide member which, when the outlet thereof is opened by the control valve, guides a flow of the fuel introduced from the pressure control chamber thereto in such. a manner that one of two flow states consisting of a turbulent flow state and a laminar flow state is exclusively formed at first and, then, maintained, always as far as fuel temperature is within a range from −30 to 80° C. and fuel pressure is within 10 to 50 M Pa.

2. A fuel injection valve according to claim 1, wherein the orifice has a smooth cylindrical straight portion whose inner diameter is smaller than that of the fuel flow-out passage on an upstream side thereof, and the guide member is turbulent flow formation means for forcibly forming the turbulent flow state before the fuel introduced into the fuel flow-out passage from the pressure control chamber reaches the smooth cylindrical straight portion of the orifice and turbulent flow maintenance means for maintaining the turbulent flow state thus formed throughout the smooth cylindrical straight portion.

3. A fuel injection valve according to claim 2, wherein dimension of the smooth cylindrical straight portion, which constitutes the turbulent flow maintenance means, satisfies a formula, $L/D \leqq 1.2$, where D is inner diameter of the smooth cylindrical straight portion and L is axial length of the smooth cylindrical straight portion.

4. A fuel injection valve according to claim 3, wherein the orifice is provided around a periphery of an inlet opening immediately adjacent the smooth cylindrical straight portion thereof with an inlet circumferential edge with which the flow of the fuel introduced into the fuel flow-out passage from the pressure control chamber is swirled so that the turbulent flow state is forcibly formed, which constitutes the turbulent flow formation means, whereby dimensions of the inlet circumferential edge satisfies a formula, $R/D \leqq 0.2$, where R is corner radius of the inlet circumferential edge of the orifice and D is the inner diameter of the smooth cylindrical straight portion.

5. A fuel injection valve according to claim 3, wherein the fuel flow-out passage including the orifice is provided in an interior thereof on an upstream side of the smooth cylindrical straight portion with at least one of two members consisting of projections and recesses with which the flow of the fuel introduced into the fuel flow-out passage from the pressure control chamber is disturbed so that the turbulent flow state is forcibly formed, which constitutes the turbulent flow formation means.

6. A fuel injection valve according to claim 3, wherein the fuel flow-out passage including the orifice is provided in an interior thereof on an upstream side of the smooth cylindrical straight portion with a flow disturbance member with which the fuel introduced into the fuel flow-out passage from the pressure control chamber is stirred so that the turbulent flow state is forcibly formed, which constitutes the turbulent flow formation means.

7. A fuel injection valve according to claim 3, wherein the fuel flow-out passage including the orifice is provided in an interior thereof on an upstream side of the smooth cylindrical straight portion with a bending portion with which the fuel introduced into the fuel flow-out passage from the pressure control chamber is guided to flow in a curve so that the turbulent flow state is forcibly formed, which constitutes the turbulent flow formation means.

8. A fuel injection valve according to claim 3, wherein the fuel flow-out passage including the orifice is provided in an interior thereof on an upstream side of the smooth cylindrical straight portion with a step portion whose diameter is stepwise changed and with which the fuel introduced into the fuel flow-out passage from the pressure control chamber is guided to flow in a curve so that the turbulent flow state is forcibly formed, which constitutes the turbulent flow formation means.

9. A fuel injection valve according to claim 2 or 3, wherein the fuel flow-out passage including the orifice is provided in an interior thereof on an upstream side of the smooth cylindrical straight portion with a flow disturbance member with which the fuel introduced into the fuel flow-out passage from the pressure control chamber is stirred so that the turbulent flow state is forcibly formed, which constitutes the turbulent flow formation means.

10. A fuel injection valve according to claim 2 or 3, wherein the fuel flow-out passage including the orifice is provided in an interior thereof on an upstream side of the smooth cylindrical straight portion with a bending portion with which the fuel introduced into the fuel flow-out passage from the pressure control chamber is guided to flow in a curve so that the turbulent flow state is forcibly formed, which constitutes the turbulent flow formation means.

11. A fuel injection valve according to claim 2 or 3, wherein the fuel flow-out passage including the orifice is provided in an interior thereof on an upstream side of the smooth cylindrical straight portion with a step portion whose diameter is stepwise changed and with which the fuel introduced into the fuel flow-out passage from the pressure control chamber is guided to flow in a curve so that the turbulent flow state is forcibly formed, which constitutes the turbulent flow formation means.

12. A fuel injection valve according to claim 2 or 3, wherein the fuel flow-out passage including the orifice is provided in an interior thereof on an upstream side of the smooth cylindrical straight portion with at least one of two members consisting of projections and recesses with which the flow of the fuel introduced into the fuel flow-out passage from the pressure control chamber is disturbed so that the turbulent flow state is forcibly formed, which constitutes the turbulent flow formation means.

13. A fuel injection valve according to claim 1, wherein the orifice has a smooth cylindrical straight portion whose inner diameter is smaller than that of the fuel flow-out passage on an upstream side thereof, and the guide member is laminar flow formation means for forcibly forming the laminar flow state when the fuel introduced into the fuel flow-out passage from the pressure control chamber passes through the smooth cylindrical straight portion on an upstream side thereof and laminar flow maintenance means for maintaining the laminar flow state thus formed when the fuel thereof passes through the smooth cylindrical straight portion on a downstream side thereof.

* * * * *